US006732848B1

(12) United States Patent
Hovanessian

(10) Patent No.: US 6,732,848 B1
(45) Date of Patent: May 11, 2004

(54) TAMPER-RESISTANT DEVICE FOR COIN ACCEPTING MACHINES

(76) Inventor: Armen David Hovanessian, 24636 Eilat St., Woodland Hills, CA (US) 91367

( * ) Notice: Subject to any disclaimer, the term of this patent is extended or adjusted under 35 U.S.C. 154(b) by 116 days.

(21) Appl. No.: 10/017,170

(22) Filed: Dec. 7, 2001

(51) Int. Cl.[7] ..... G07F 1/02
(52) U.S. Cl. ..... 194/343; 194/351
(58) Field of Search ..... 194/203, 343, 194/351

(56) References Cited

U.S. PATENT DOCUMENTS

| | | | | | |
|---|---|---|---|---|---|
| 938,900 | A | * | 11/1909 | Schmitt | 194/343 |
| 2,913,087 | A | * | 11/1959 | Lamb | 194/244 |
| 3,243,030 | A | * | 3/1966 | Tryon et al. | 194/343 |
| 4,717,007 | A | | 1/1988 | Van Horn | |
| 4,848,556 | A | * | 7/1989 | Shah et al. | 194/212 |
| 5,402,871 | A | * | 4/1995 | Mercurio | 194/203 |

* cited by examiner

*Primary Examiner*—F. J. Bartuska

(57) ABSTRACT

A tamper-resistant device retrofits onto an existing parking meter or other coin accepting machine to increase the exterior security of the parking meter at the point where the coins are deposited into the parking meter. Accordingly, potential thieves and vandals would not have direct access to the internal components of the parking meter, thereby eliminating the possibility of intentionally stuffing and blocking the coin track by inserting objects other than coins into the coin track. The tamper-resistant device provides a deposit slot spaced apart from the original coin slot for depositing one coin at a time into the parking meter. By relocating the deposit slot, the tamper-resistant device prevents vandals from inserting hard objects directly into the parking meter, thereby damaging the internal components of the parking meter. The tamper-resistant device comprises generally, three components: a support structure that is rigidly secured to the parking meter; a movable coin receiving structure that moves within the support structure in the horizontal direction and provides a cradle for moving the coin; and a coil spring that causes the coin receiving structure to move back into its original position after being depressed. After the insertion of a coin in the deposit slot of the tamper-resistant device, a potential user depresses the coin receiving structure and moves the coin to align with the original coin slot and coin track, thereby closing the opening of the deposit slot simultaneously upon alignment of the coin with the exit slot as it then slides down into the original coin slot and coin track.

21 Claims, 4 Drawing Sheets

TAMPER-RESISTANT DEVICE FOR COIN ACCEPTING MACHINES

FIELD OF THE INVENTION

The invention relates generally towards coin accepting machines, such as a parking meter, coin operated telephone, or vending machine, and more specifically towards an anti-theft, vandal-resistant device which attaches to any existing coin accepting machine, to prevent jamming the coin acceptance portion and coin track to prevent theft of coins, stuffing objects and damaging the internal components of the unit or otherwise vandalizing the unit.

BACKGROUND OF INVENTION

As used herein, the term "coin accepting machine" includes any machine that accepts coins through a coin slot in return for a product or service and includes, but is not limited to, a parking meter, a coin operated telephone, a vending machine or coin changing machine. While the present invention will be described in conjunction with the problems that arise with parking meters, one of skill in the art would recognize that the present invention may be used, or adapted for use, with any coin accepting machine that utilizes a coin slot and a coin track.

Parking meters, and consequently their owners and users, are often victims of vandals and thieves. As is well known, a typical parking meter has a coin deposit slot where the user deposits coins through the slot thereby registering time on the parking meter. Thieves and vandals stuff objects through the slot into the coin track either manually or with the aide of a long wire to block the coin track. When the coin track is blocked, coins are prevented from passing through the coin track and dropping into the coin vault. As users deposit coins into the coin track, the coins back up in the coin track towards the coin slot. Thieves then return and fish out the coins with a wire from the coin slot leaving the parking meter in a jam mode which is inoperable, thereby causing a costly maintenance visit to clear the jam in the coin track. These jams also may contribute to the permanent damage of the coin track, which would require the replacement of the coin track or the motherboard. Expanded paper clips or paper is often used as jamming material. Another form of thievery is conducted by the thieves registering time on the parking meter by moving a wire with or without a coin soldered to the wire and soliciting payment from a potential user at a reduced rate than the user would otherwise have to have deposited in the parking meter.

Additionally, individuals vandalize the parking meters by stuffing a paper clip or other objects into the coin track, thereby jamming the parking meter, parking for free at a broken meter, and avoiding a parking citation. Moreover, there are individuals who vandalize the internal components of the parking meter by having direct access to delicate internal components of the parking meter and jamming knives, or other hard objects, into the coin track and moving it side-to-side, or forcing the object straight into the coin track, which damages the internal components of the parking meter.

BRIEF SUMMARY OF THE INVENTION

The present invention is directed towards an anti-theft, vandal-resistant (hereinafter a "tamper-resistant") device that attaches to the outer assembly of a coin accepting machine, such as the parking meter described above, or any other coin operated telephone, vending machine or coin changing machine having a coin slot that can be similarly vandalized.

The tamper-resistant device is attached over the original coin slot and isolates the original coin slot on the parking meter by providing a "movable" coin slot which moves a coin in the horizontal direction from a theft-proof position to the original coin slot and coin track. By having a "movable" coin slot, the device simultaneously closes the opening on the user's side to prevent the insertion of objects into the coin track to block or damage the coin track. By preventing the blockage of the coin track, thieves and vandals would not be able to block the coin track or damage the unit to either fish out coins from the parking meter or park for free at a broken parking meter.

In an alternate embodiment, the present invention can be contained within a customized front panel of the coin accepting machine so that the "movable" coin slot that moves a coin in the horizontal direction from a theft-proof position to the original coin slot and coin track is embedded within or integral to the coin accepting machine.

BRIEF DESCRIPTION OF THE SEVERAL VIEWS OF THE DRAWING

The above and further features, advantages and benefits of the present invention will be apparent upon consideration of the following detailed description, taken in conjunction with the accompanying drawings, in which like reference characters refer to like parts throughout, and in which.

DETAILED DESCRIPTION OF THE INVENTION

The following description is the best mode presently contemplated for practicing the invention. This description is not to be taken in a limiting sense but is made merely for the purpose of describing the general principles of the invention. The scope of the invention should be ascertained with reference to the issued claims.

Figure 1:
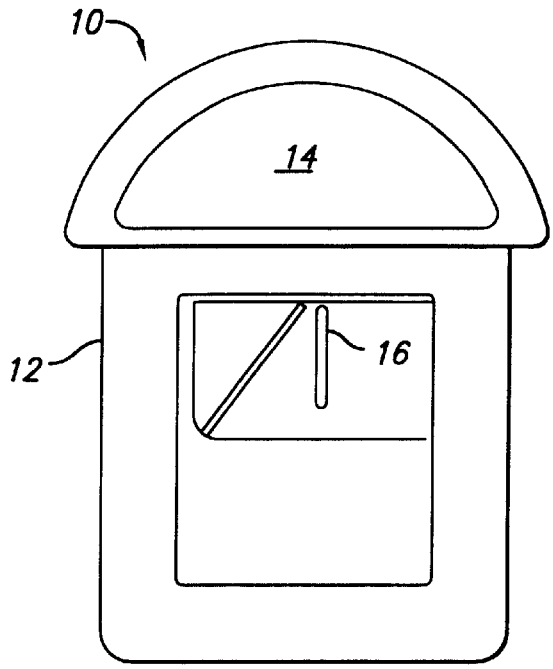
FIG. 1 PRIOR ART
FIG. 1 is a plan view of a parking meter of the prior art.

Referring now to the figures of the drawings in detail and first, particularly, to FIG. 1, there is shown a coin accepting machine in the form of a parking meter 10 known in the prior art. While the rest of this description will be directed towards a tamper-resistant device to prevent theft and/or vandalism of a parking meter 10, it is within the scope of the invention to include all variations of parking meters that have a coin accepting slot and coin track, and other coin accepting machines that have a similar coin accepting slot and a coin track, such as coin accepting telephones, vending machines, and coin changers.

In FIG. 1, the parking meter 10 of the prior art contains a housing 12 and a display 14 for displaying the time remaining on the meter. On the front of the parking meter 10 is a coin slot 16 for accepting coins. A coin that is inserted into the coin slot 16 is guided by a coin track (not shown) into a container or "coin vault" (not shown) within the housing 12, as in known in the art. As mentioned earlier, the coin track is an easy theft and vandalism target.

Figure 2:
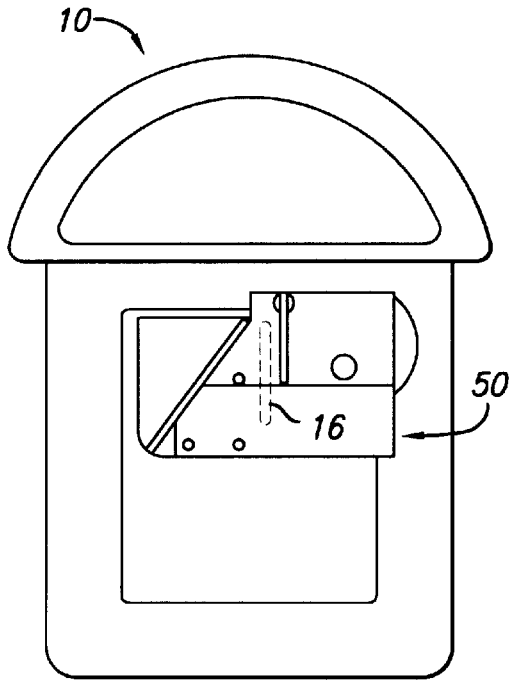
FIG. 2 is a plan view of a parking meter with the tamper-resistant device of the present invention mounted thereon.

In FIG. 2 is a plan view of a parking meter 10 with a tamper-resistant (both anti-theft and vandal-resistant) device 50 of the present invention mounted thereon. A basic feature of the invention is to prevent direct access of the original coin slot 16, the coin track and the coin vault of the parking meter 10.

Figure 3:
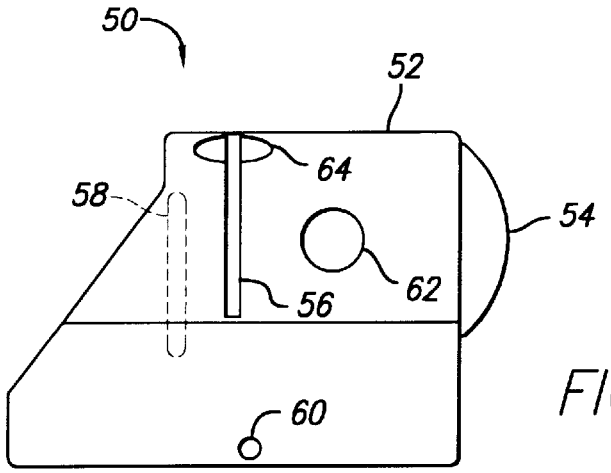
FIG. 3 is a plan view of the tamper-resistant device without the parking meter.
Figure 4:
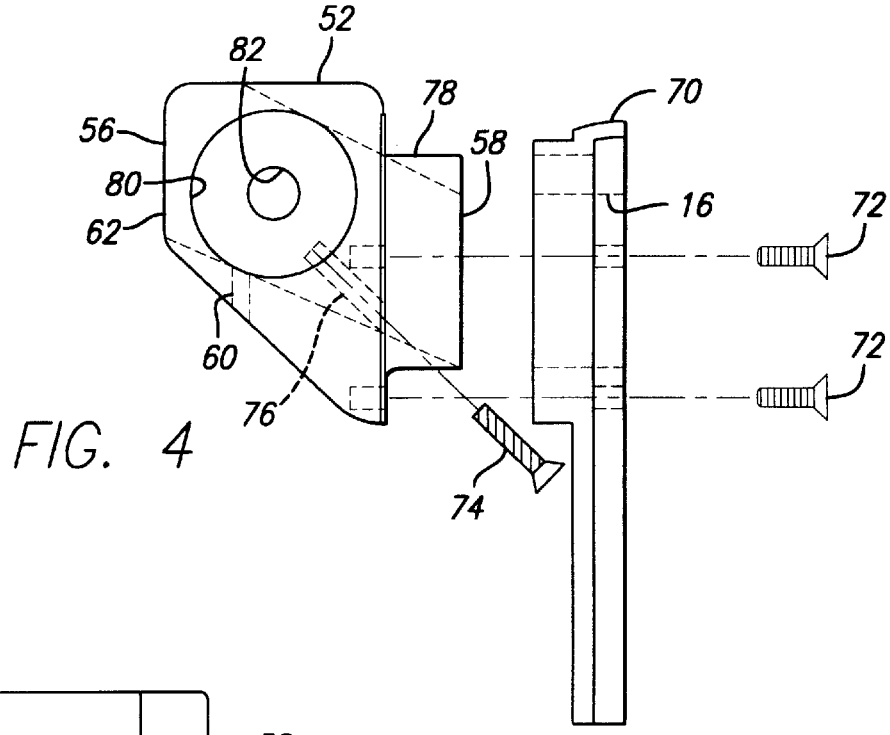
FIG. 4 is a side exploded view of the tamper-resistant device and the mounting front plate of the parking meter.
Figure 5:
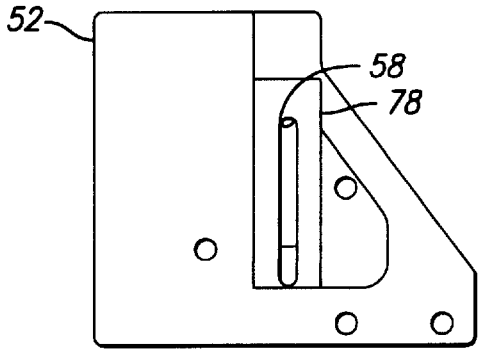
FIG. 5 is a rear plan view of the tamper-resistant device.

With reference to the detailed views shown in FIGS. 3–5, the front, side and rear views of the tamper-resistant device are illustrated. As best seen in FIG. 3, the tamper-resistant device 50 has two main components: a non-moving component or frame, hereinafter referred to simply as a "support structure" 52, and a movable coin receiving structure, hereinafter referred to simply as a "button" 54, that moves a coin from a first position spaced apart from the original coin slot 16 on the housing 12 of the parking meter 10. In this view, a first slot 56 in the support structure 52, hereinafter a "deposit slot" 56, is shown for passing coins therethrough. As will be shown later, the deposit slot 56 is not aligned with the original coin slot 16 and coin track of the parking meter 10.

Other features illustrated in FIG. 3 include a drainage channel 60 for draining rain or other moisture out of the tamper-resistant device 50. An optional feature is a view window 62 that reveals one or more color-coded areas on the button 54 (preferably the color green, as the universal indicator for "open" or "ready" and/or the color red, as the universal indicator for "closed") to indicate when coins can and cannot be inserted, respectively. In the unlikely event that the device 50 should jam, the color-coded indicator would preferably highlight red in the view window 62 indicating "closed".

The deposit slot 56 may be dimensioned to optimized tactile sensation through the use of a depression area 64 that conforms approximately to a finger tip. The deposit slot 56 may also be entirely on the front face of the device 50, or straddle the top and front face to facilitate insertion of the coins.

As shown in FIGS. 4 and 5, the support structure 52 is rigidly mounted to a front panel 70 of the parking meter 10 through the use of two or more (preferably at least three) screws 72 or other secure means (e.g., bolts, rivets, etc.) from behind front panel 70, thereby aiding in making the device "tamper-resistant". Advantageously, the present invention can be used with a custom-made front panel 70 with appropriate holes pre-drilled to accept the screws 72, or the holes may be drilled wherever the parking meter 10 is located (at the factory or at its permanent site), thereby allowing upgrades to be made in the field for all existing parking meters.

As also seen in FIGS. 4 and 5, a threaded screw 74 is inserted into a bore 76 of the support structure 52 to act as a cam, which will mate with a follower located on the button 54. The strength of the mounting of the support structure 52 is further reinforced by a protruding portion 78 surrounding an exit slot 58 that will be shaped to accommodate the front plate attachment by mating to the original coin slot 16 on the front panel 70 of the housing 12 of the parking meter 10. The protruding portion 78 is lower than the deposit slot 56 on the front of the support structure 52 to permit an incline drop angle of about 24 degrees between the deposit slot 56 and the exit slot 58.

Also seen in FIG. 4 is a large bore 80 that receives the movable coin receiving structure, or button 54 (FIG. 5). At the distal end of the large bore 80 is a smaller recess 82 that contains a spring (not shown) which acts against the movement of the button 54, as will be described in more detail below in conjunction with FIGS. 10 and 11.

Figure 7:
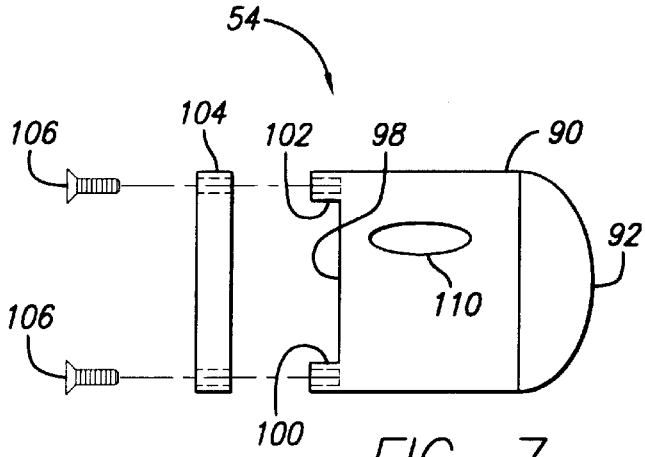
FIGS. 6–7 are plan views of a front and back views of the movable coin receiving structure (e.g., a button) which cradles and carries the deposited coins horizontally and aligns the coin with the original coin slot and coin track of the parking meter.
Figure 6:
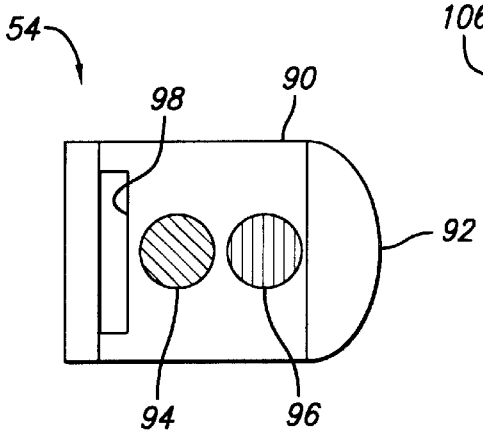

FIGS. 6 and 7 are plan views of a front, and back sides of the movable coin receiving structure (e.g., the button 54) which cradles and carries the deposited coin horizontally and aligns the coin with the original coin slot 16 and coin track of the parking meter 10. The front and back side views shown in FIGS. 6 and 7 illustrates a cylinder 90 having a rounded end 92 suitably configured to completely cradle any size coin and to further act as a button. As can also be seen in FIG. 6, two areas 94 and 96 on the front surface of the button 54 are designed to receive a color code, such as the color green in area 94, as indicated above for the universal indicator for "open" or "ready" and/or the color red in area 96, as the universal indicator for "closed". These areas are preferably recessed areas that are painted (or labeled) red, because the recessed area then prevents the paint (or label) from coming in contact with the inner surface of the bore 80 of the support structure 52 and being scraped off after continued annual use.

As best seen in FIG. 7, a coin cradle 98 (i.e., an area that receives the coin and cradles the coin as it moves between two positions, i.e., the "receiving" position and the "depositing" position) is formed within the button 54 by machining a slot therethrough or, more practically speaking, by machining a recessed area having two sides 100 and 102 and attaching a disk 104 thereon via two pins 106, rivets or screws.

The back side of the button 54, in FIG. 7, illustrates another recess 110 that forms a follower and mates with the cam (actually screw 74) on the support structure 52. When the cam 74 engages with the recess/follower 110, the cam 74 follows a horizontal line and limits the range of total movement. The cam 74 follower also aids in keeping the color-coded areas 94 and 96 in proper alignment with the view window 62 on the support structure 52. The cam 74 and follower 110, in turn, also prevent the button 54 from being removed from the support structure 52, thereby also aiding in making the device "tamper-resistant".

Figure 8:
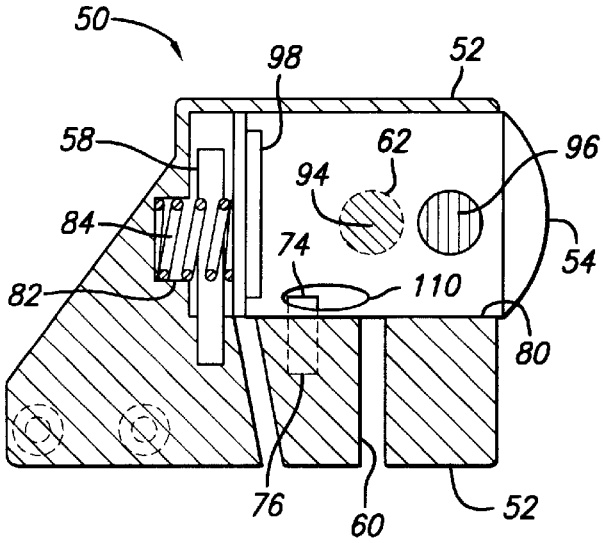
FIG. 8 is a partial sectional view of the tamper device illustrating the button in a first position corresponding to the 'coin receiving' position.

To assemble the tamper-resistant device 50, the spring 84 is loaded into the recess 82 of the support structure 52, as seen in FIG. 8. The button 54 is loaded into the large bore 80 against the spring 84. The cam or screw 74 is screwed, or otherwise inserted, into the appropriate channel 76 and mates with the follower 110 on the button 54. The support structure 52 is then mounted onto the housing 12 of the parking meter 10 from the back side of the front panel 70 of the parking meter 10 so that no attachment means (e.g., screws, pins, bolts, etc.) are accessible to a potential vandal or thief.

Figure 9:
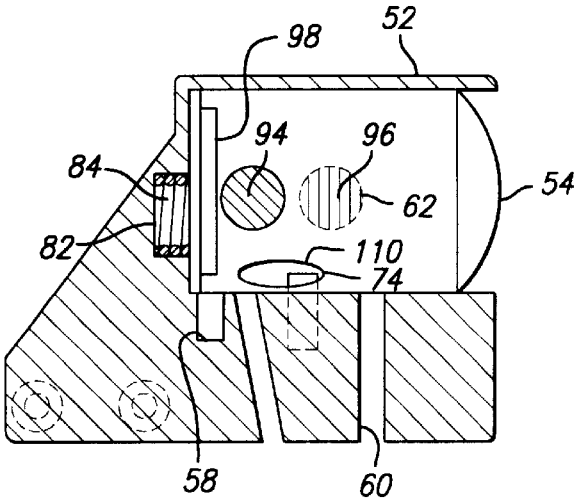
FIG. 9 is a partial sectional view of the tamper-resistant device illustrating the button in a second position corresponding to the "depositing position" or "exit slot 58" aligned with the original coin slot and coin track of the parking meter.

As shown in FIGS. 8 and 9, a partial cross section/partial plan view of the invention in the first ("receiving") and second ("depositing") positions, respectively. FIG. 8 shows the spring 84 in the recess 82 in its expanded, or relaxed, state. In this configuration, the device 50 is waiting for a coin to be received and a force to be applied against the button 54. The color-coded viewer 62 (shown in this view as dotted lines to indicate the region on the button 54 that would be visible) may indicate the color "green" (area 94) as the universal symbol for "ready".

FIG. 9 shows the compressed spring 84 in the recess 82 of the support structure 52 while the button 54 is depressed, typically when a user deposits a coin into the deposit slot 56 on the support structure 52 (the coin has been omitted here for clarity). The coin then is cradled by the coin cradle 98 within the button 54.

By depressing the button 54, the spring 84 is compressed and the coin is moved from a first position (i.e., the "receiving position" shown in FIG. 8) and aligned with a second position (i.e., the "depositing position" shown in FIG. 9) where it ejects out the exit slot 58 and falls into the original coin slot 16, coin track and container of the parking meter 10. The color-coded viewer 62 (shown in this view as dotted lines to indicate the region on the button 54 that would be visible) may indicate the color "red" (area 96) as the universal symbol for "closed".

As seen in both of these views, the drainage channel 60 provides drainage for potential moisture that may occur due to rain during daily use.

Figure 10:
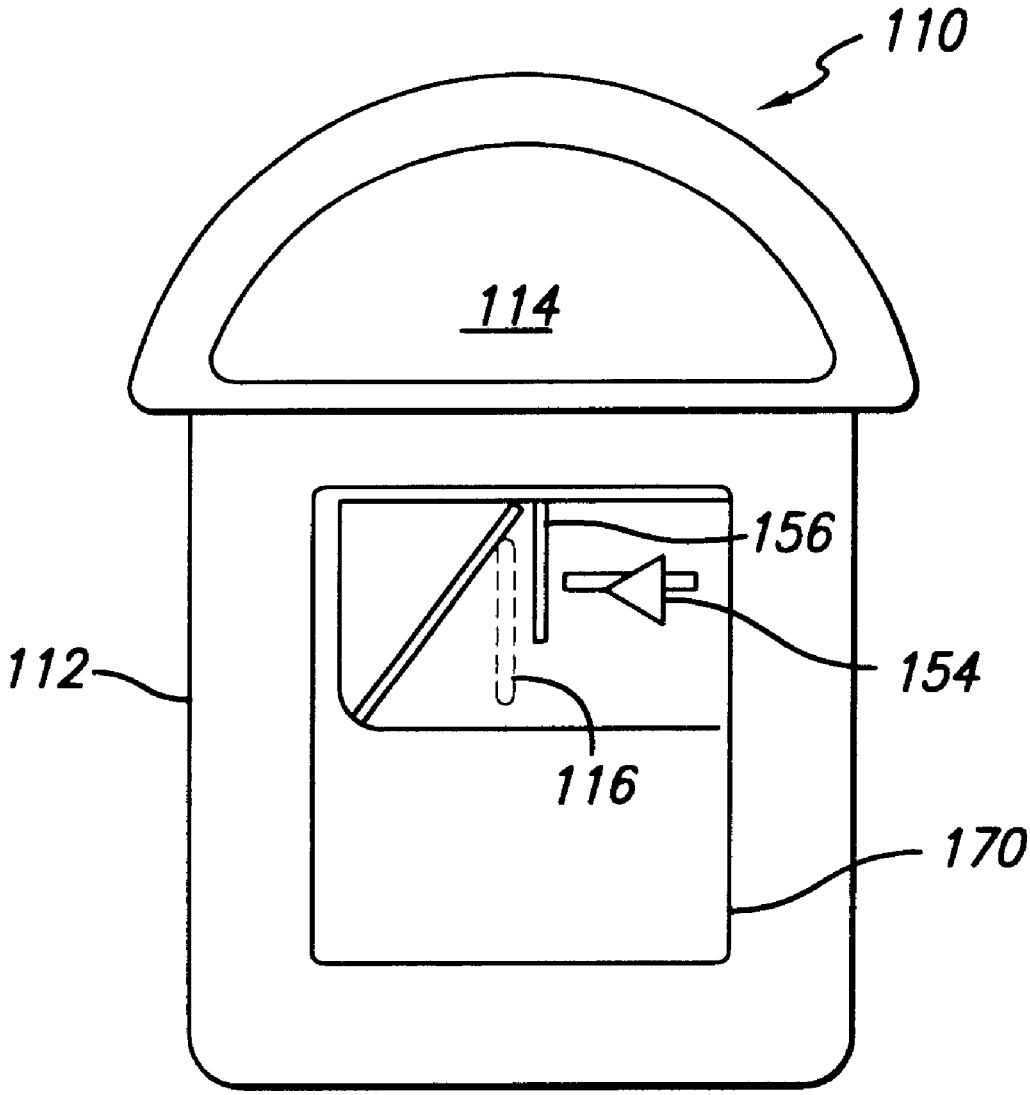
FIG. 10 is a plan view of an alternate embodiment for a tamper-resistant parking meter of the present invention with the movable coin receiving structure mounted internal to the parking meter housing.

While it has been shown that a tamper-resistant device 50 can be manufactured to adapt to any existing parking meter, as well as other coin accepting machines, FIG. 10 further illustrates that the principles of the present invention can be contained within a customized front panel 170 so that it is embedded within or integral to the coin accepting machine 110.

In FIG.10, the parking meter 110 of the contains a housing 112 and a display 114 for displaying the time remaining on the meter. On the front of the parking meter 110 is a deposit slot 156 for accepting coins and an exit slot 116 that is not accessible to the user (as indicated by the hidden lines). In this embodiment, direct access of the exit slot 116, the coin track (not shown) and the coin vault (not shown) of the parking meter 110 is also prevented. A coin that is inserted into the deposit slot 156 is moved by a movable coin receiving structure, such as a "button" or "lever" 154, that moves a coin from a first position spaced apart from the exit slot 116 on the housing 112 of the parking meter 110. As described above, the deposit slot 156 is not aligned with the exit slot 16 and coin track of the parking meter 10.

The movable coin receiving structure (e.g., the button or lever 154) may be similarly shaped as described above in conjunction with FIGS. 6 and 7, that is, the movable coin receiving structure is generally shaped as a cylinder that cradles and carries the deposited coin horizontally and aligns the coin with the exit slot 116 and coin track of the parking meter 110. Color-coded areas for indicating "open" or "closed" may also be included. A drainage hole is also generally desirable to allow moisture to drain.

The main difference between the parking meter 110 and the parking meter 10 is the function of the support structure has been integrated into a single front panel. Thus, the front panel and "button" may be modified in a variety of ways for aesthetic or tactile purposes without deviated from the spirit of the invention.

It will therefore be perceived that the advantages of the present invention result in a tamper-resistant device that prevents direct access to the original coin slot, coin track and container, thereby preventing thieves and vandals from stuffing objects through the slot, fishing out the coins with a wire, jamming the coin track, preventing damage to the delicate internal components of the parking meter, removal of coins, and possible fraud by others who solicit payment from a potential legitimate user at a reduced rate than the user would otherwise have to have deposited in the parking meter, thereby making the present invention a highly desirable enhancement to coin accepting machines.

Although an exemplary embodiment of the present invention has been shown and described, it will be apparent to those having ordinary skill in the art that a number of changes, modifications, or alterations to the invention as described herein may be made, none of which depart from the spirit of the present invention. Obviously, the structural support of the tamper-resistant device would have to undergo some modification in order to accommodate any parking meter or other coin accepting apparatus that has a coin slot in alignment with a coin track, similar to the parking meter shown. All such changes, modifications, and alterations should therefore be seen as within the scope of the present invention.

What is claimed is:

1. A tamper-resistant device for converting a non-tamper-resistant coin accepting machine into a tamper-resistant coin accepting machine, the non-tamper-resistant coin accepting machine having a first housing with a vertically-disposed front panel, a vertically-oriented non-tamper-resistant coin slot for accepting coins, a container for holding the coins, and a coin track for guiding the coins from the coin slot to the container, the tamper-resistant device comprising:

a second housing having a vertically-oriented deposit slot and a vertically-oriented exit slot, the exit slot being horizontally and vertically offset from the deposit slot, the second housing being mounted onto the external surface of the front panel of the first housing so that the exit slot is in alignment with the non-tamper-resistant coin slot, the exit slot being configured with a drop angle so that a coin can roll along the drop angle through the exit slot and into the non-tamper-resistant coin slot, the second housing having a bore therein;

securing means for securing the second housing to the front panel of the first housing in a tamper-resistant manner; and a coin receiving structure, located within the bore of the second housing, that has a coin cradle that is movable between the deposit slot and the exit slot, wherein the coin receiving structure is configured to be non-removable by the user;

whereby when the second housing is mounted on the first housing, the non-tamper-resistant coin slot is converted to a tamper-resistant coin slot, such that when a coin is inserted into the deposit slot and received in the coin cradle, a user then moves the coin receiving structure to align the coin cradle with the exit slot and thus depositing the coin in the non-tamper-resistant coin slot in the coin accepting machine.

2. The tamper-resistant device, as recited in claim 1, wherein:

the coin receiving structure further comprises a user accessible area that is suitably-shaped and functions as a button to move the coin in alignment between the deposit slot and the exit slot.

3. The tamper-resistant device, as recited in claim 1, further comprises:

a spring mechanism which causes the coin receiving structure to align the coin cradle with the deposit slot when in a relaxed state, and aligns the coin cradle with the exit slot when in a compressed state.

4. The tamper-resistant device, as recited in claim 1, wherein the second housing further comprises a drainage channel to drain moisture from the second housing and the coin receiving structure.

5. The tamper-resistant device, as recited in claim 1, wherein:

the second housing further comprises a view window; and the coin receiving structure further comprises an area that is color-coded that appears in the view window to indicate a "closed" position corresponding to the coin cradle being aligned with the exit slot, whereby additional coins cannot be inserted.

6. The tamper-resistant device, as recited in claim 5, wherein the area that is color-coded is red.

7. The tamper-resistant device, as recited in claim 1, wherein:

the second housing further comprises a view window; and the coin receiving structure further comprises an area that is color-coded that appears in the view window to indicate an "open" position corresponding to the coin cradle being aligned with the deposit slot, whereby the coin can be inserted.

8. The tamper-resistant device, as recited in claim 7, wherein the area that is color-coded is green.

9. The tamper-resistant device, as recited in claim 1, wherein the coin accepting machine is a parking meter.

10. The tamper-resistant device, as recited in claim 1, wherein the coin accepting machine is a coin accepting telephone.

11. The tamper-resistant device, as recited in claim 1, wherein the coin accepting machine is a vending machine.

12. The tamper-resistant device, as recited in claim 1, wherein the coin accepting machine is a coin change machine.

13. The tamper-resistant device, as recited in claim 1, further comprises:

resilient means which causes the coin receiving structure to align the coin cradle with the deposit slot when in a relaxed state, and aligns the coin cradle with the exit slot when in a compressed state.

14. The coin accepting machine, as recited in claim 1, wherein:

the front panel further comprises a view window; and the coin receiving structure further comprises an area that is color-coded that appears in the view window to indicate a "closed" position corresponding to the coin cradle being aligned with the coin slot, or an "open" position corresponding to the coin cradle being aligned with the deposit slot.

15. The tamper-resistant device, as recited in claim 1, wherein:

the coin receiving structure further comprises a cylinder dimensioned to accept a variety of coin sizes that are expected to be inserted.

16. The tamper-resistant device, as recited in claim 1, wherein:

the coin receiving structure comprises a cam-follower arrangement configured to limit the range of movement of the coin, and further configured to prevent removal of the coin receiving structure.

17. The tamper-resistant device, as recited in claim 5, wherein the area that is color coded comprises a recessed area not in contact with the second housing.

18. The tamper-resistant device, as recited in claim 8, wherein the area that is color coded comprises a recessed area not in contact with the second housing.

19. The tamper-resistant device, as recited in claim 1, wherein the coin receiving structure further comprises:

means for holding a variety of sized coins.

20. The tamper-resistant device, as recited in claim 1, wherein the coin receiving structure comprises:

means for limiting the range of movement of the coin, and means for preventing removal of the coin receiving structure.

21. The tamper-resistant device, as recited in claim 1, wherein the coin receiving structure comprises:

means for indicating when the coin cradle is jammed in the coin receiving structure.

* * * * *